United States Patent [19]

Artusi et al.

[11] Patent Number: 4,510,014

[45] Date of Patent: Apr. 9, 1985

[54] APPARATUS FOR SEALING A FILM OR FOIL OR THE LIKE ON TO A CONTAINER

[76] Inventors: Aldo Artusi, Mühleboden 661, CH-8461 Trüllikon; Peter Hagmann, Bielstr. 95, CH-4500 Solothurn, both of Switzerland

[21] Appl. No.: 555,035

[22] Filed: Nov. 23, 1983

[30] Foreign Application Priority Data

Nov. 25, 1983 [DE] Fed. Rep. of Germany ..... 3243634

[51] Int. Cl.[3] ..... B31F 5/00

[52] U.S. Cl. ..... 156/522; 53/373; 53/389; 156/69; 156/583.3

[58] Field of Search ..... 186/221, 224, 538, 212–214, 186/556, 517, 522; 53/371, 373, 389, 329; 156/69

[56] References Cited

U.S. PATENT DOCUMENTS

| | | | |
|---|---|---|---|
| 2,558,368 | 6/1951 | Malhiot | 53/579 |
| 2,930,171 | 3/1960 | Mason | 53/389 X |
| 2,952,958 | 9/1960 | Theiler | 53/389 X |
| 3,693,318 | 9/1972 | Balyer | 53/389 X |
| 4,145,239 | 3/1979 | Fujii | 156/224 X |
| 4,282,699 | 8/1981 | Embro | 53/373 X |

*Primary Examiner*—David Simmons

*Attorney, Agent, or Firm*—Bachman and LaPointe

[57] ABSTRACT

An apparatus and method for sealing a film or foil or the like on to a container, by means of a downwardly movable heating device which is arranged between two columns or pillars bridged by a transverse member and below which the container can be passed, in a carrier member, are to be such that the operation of applying the film or foil to the container is automated and the operating procedure is accelerated.

For the purpose, a clamping means (K) is coupled to the carrier member (15), for receiving the film or foil (62) or the like, wherein the clamping means comprises guide means (70) which are secured to the columns or pillars (5, 6) and on which there are slidably disposed slide members (71) which each have a respective lever (72) passing therethrough, each said lever being provided with a beak-like projection or lug (73) and being rotatable about an axis (A), the slide members and the levers together forming a clamping gap (74) for receiving the film or foil (62), wherein the lever (72) is connected to the carrier member (15) at the other end from the beak-like projection or lug (73).

The method according to the invention is distinguished in that, when the carrier member is moved into a position below the heating device, the film or foil or the like is entrained by a clamping means and laid over the container. The film or foil is to be taken from a roll and fed to the clamping means, its direction being deflected into the direction of movement of the carrier member, by way of a slot.

7 Claims, 5 Drawing Figures

APPARATUS FOR SEALING A FILM OR FOIL OR THE LIKE ON TO A CONTAINER

The present invention relates to an apparatus for sealing a film or foil or the like on to a container, by means of a downwardly movable heating device which is arranged between two columns or pillars bridged by a transverse member and below which the container can be passed, in a carrier member.

An apparatus of that kind is disclosed in German patent application No. P 32 10 566.5. That application claims protection in particular for the configuration of a given drive unit for downward movement of the heating device and for the control unit for controlling the operating movements of the apparatus.

It was also provided that a film or foil which is cut to the required finished size is laid on the container, then the container together with the carrier member is pushed into position below the heating device and then the heating device is moved downwardly.

The object set by the present inventor was to automate the operation of applying the film or foil to the container, thereby speeding up the operating procedure.

To attain that object, a clamping means for receiving the film or foil or the like is coupled to the carrier member.

In accordance with the present invention, the clamping means is to comprise two guide means which are fixed to the inward sides of the respective columns or pillars. The guide means may be simple rail portions of for example square or rectangular section. They are secured to the columns or pillars by screws or other fixing means. Slide members are disposed slidably on the guide means. Both the slide members and the guide means each have a respective lever passing therethrough; together with a part of the surface of the respective slide member and a beak-like projection or lug formed thereon, the lever forms a clamping gap for receiving the film or foil. Adjacent to the projection or lug, the lever has a pivot axis about which the lug or projection can be moved to and fro, relative to the surface of the slide member.

The lever is coupled to the carrier member by means of a foot or base portion. The connection between the base portion of the lever and the carrier member may be of any known pivotal kind. Preferably, the foot or base portion rests in a channel formed on the carrier member. In that way, the carrier member can be separated from the clamping means, without releasing additional coupling elements.

The pivot axis about which the lever is rotatably mounted is preferably disposed adjacent to the beak-like lug or projection in order to increase the lever action or leverage which acts on the lug or projection, when the carrier member is displaced, by way of the base or foot portion of the lever.

In order to have the necessary clearance for the movements involved, the guide means is interrupted by an opening in which the lever, together with the slide member, can slide along the guide means.

According to the invention, the longitudinal axis of the guide means is to extend at an inclined angle with respect to the direction of forward movement of the carrier member. In that way, the clamping gap can be moved towards the film or foil and, after receiving same, can be positioned over the carrier member or the container carried thereby.

In addition, the slide members are intended clampingly to embrace their respective guide means. In order to overcome that force, the pressure on the carrier member must be increased. Because of that however, the lever force which can be transmitted to the beak-like lug or projection on the lever is also increased. The film or foil is more securely held in that way.

In order in any case to ensure that the film or foil can be fed to the clamping gap at the same location, a slot means which is formed from two strip portions is disposed adjacent the clamping means, in the terminal position thereof. Individual film or foil portions which are cut to the finished configuration can be introduced into the slot means. As however, preferably, the individual portions of film or foil material are to be separated from a roll which at the same time is advantageously mounted on the transverse member, the slot means should form an elbow bend configuration in order to deflect the film or foil into the direction of forward feed movement of the carrier member.

As the operation of introducing the film or foil from a roller and changing the direction thereof, in the region of the elbow bend configuration, without direct access thereto, gives rise to difficulties, in accordance with the present invention, the outer strip portion of the strip portions defining the slot means is to be interrupted by elongate holes which permit access to the film or foil.

In order now that the film or foil portion which is to be sealed on to the container can be separated or severed from the remainder of the roll, the invention provides that a severing means is disposed adjacent to the exit end of the slot means. In the present embodiment, the severing means comprises a loop arrangement having an end beam or bar and two support arms. A severing tool is disposed underneath the end beam or bar. In accordance with the invention, in the rest condition of the entire sealing apparatus, the end beam or bar, with the severing tool, is to be masked by parts of the heating device, in particular the cover plates thereof. In that connection however, the end beam or bar projects laterally from the cover plate at each side thereof, where it is connected to the support arms. The support arms are to be pivotally connected on the outside to the cladding or covering of the heating device, adjacent to the end beam or bar, by way of a pivot means. In contrast, the ends thereof which are remote from the end beam or bar are to embrace pins or bolts which are secured to the columns or pillars, with the pins or bolts being movable in a recess.

The severing means is proposed in the form of a heating wire which is stretched between two electrodes, underneath the end beam or bar.

Other embodiments or mounting means for the severing tool are also within the scope of the invention. Thus, for the sake of simplicity, the severing tool, which is therefore for example a heating wire, may extend directly underneath the lower edge of the casing or cladding. Alternatively, an end beam or bar is clamped between the two lateral cladding or casing plates and carries the severing tool. When the heating device is lowered, a severing tool secured in position in that way also effectively severs the portion of film or foil to be sealed on to the container, from the roll.

In accordance with the invention, the cladding or casing of the heating device encloses a heating member. The heating member may preferably comprise two plates which can be easily separated from each other. For that purpose, the inventors developed a pressure closure means, wherein at least one pin projects out of the actual lower sealing plate; the pin projects with a spherical head through the other plate and is there held in position by two clips or clasps which produce a clamping action, in the manner of a press fastener. By virtue of that arrangement, the sealing plate which is usually provided on its underside with projections which are determined by the sealing seam which is to be produced, can be easily interchanged and adapted to the predetermined form of container involved. However, other conventional securing elements for securing two releasable plates may also be envisaged.

The invention also concerns a method of sealing a film or foil or the like on to a container by means of a downwardly movable heating device which is arranged between two columns or pillars bridged by a transverse member and below which the container is passed in a carrier member, wherein, when the carrier member is moved into a position below the heating device, the film or foil or the like is entrained by a clamping means and is laid over the container.

The particularly advantageous aspect of that method lies in automation of the sealing operation, in which respect the operating procedure can be considerably speeded up.

In general, the apparatus is of an extremely simple design configuration and can therefore be manufactured very inexpensively. It is particularly suitable for use for example in butcher shops or retail shops which cannot afford high levels of capital investment costs for the known expensive sealing machines. By virtue of the automation of the operation of applying the material to be sealed on to a container, in accordance with the present invention, the apparatus is also attractive from the point of view of users thereof who are required to seal off containers very rapidly and frequently.

Further advantages, features and details of the present invention will be apparent from the following description of preferred embodiments by way of example and with reference to the accompanying drawings in which.

Figure 2:
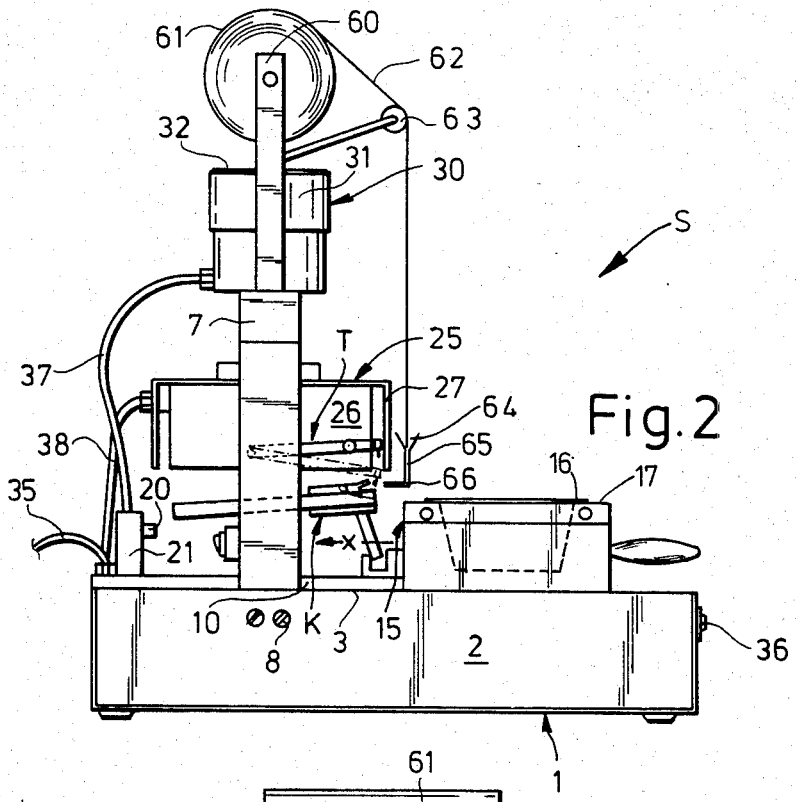
FIG. 2 shows a side view of the apparatus shown in FIG. 1.
Figure 1:
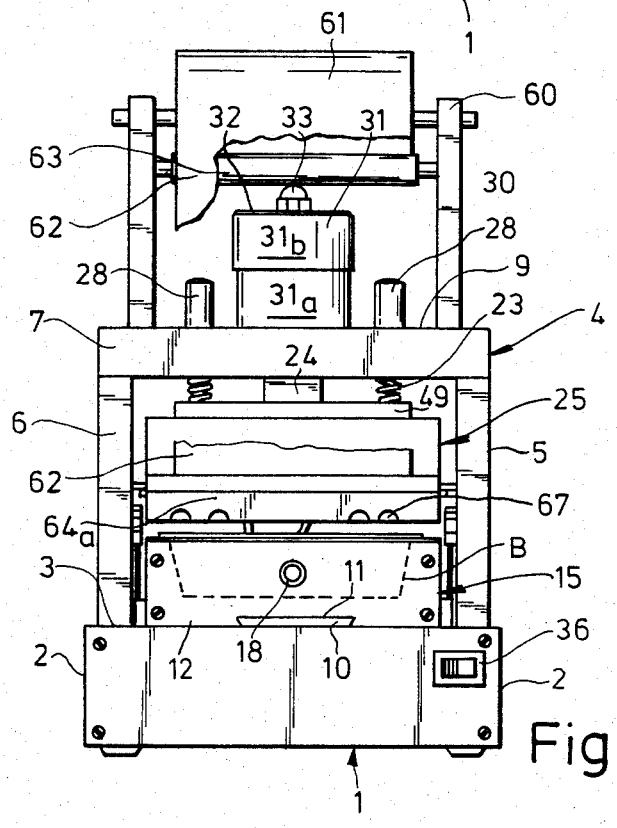
FIG. 1 shows a front view of an apparatus for sealing containers.

An apparatus S, in particular for sealing containers B, as shown in broken lines in FIGS. 1 and 2, comprises a support housing or casing 1, the longitudinal side of which is denoted by reference numeral 2. Secured to the longitudinal side 2 of the housing 1 is a portal structure 4 which bridges over the top side 3 of the housing and which comprises two columns or pillars 5 and 6 and a transverse member 7. The portal structure 4 is secured to the longitudinal side 2 by means of screws 8 or the like.

Arranged on the longitudinal axis (not shown) of the housing 1, on the top side 3 thereof, is a rail 10 which is engaged with a groove 11 formed in the bottom 12 of a drawer member 15. The container B is mounted in the drawer member 15, with the outwardly bent marginal edge portions 16 of the opening of the container B being supported on the top side 17 of the drawer member 15.

Being guided by means of the rail 10 and the groove 11 and being held at a knob 18, the drawer member 15 can be moved in the lengthwise direction of the longitudinal axis of the housing 1. When the drawer member 15 is displaced in the direction x shown in FIG. 2, it passes between the columns or pillars 5 and 6 of the structure 4 and abuts against a pressure switch 20 which is secured to a mounting unit or block 21.

Disposed between the two pillars or columns 5 and 6 and suspended on two coil springs 23 and a square or rectangular member 24 is a mounting means 49 for a heating device 25 comprising a heating member 26 and a downwardly open casing or cladding 27 which engages over the heating member 26. Both the coil springs 23 and the member 24 extend through the transverse member 7. The coil springs 23 are mounted and guided in sleeves 28 on the top side 9 of the transverse member 7 and are secured to the bottoms of the sleeves, in a manner not shown in the drawing.

Disposed between the two sleeves 28 is a drive or actuating means 30, the internal parts of which are enclosed by a protective casing or cover 31 which comprises a lower portion **31*a* which is supported on the transverse member 7, and an upper portion 31*b* which engages over the lower portion 31*a*. A cap nut 33 is disposed at the end part of the upper portion 31*b***.

For the purposes of supplying the apparatus S with power, it has a supply line 35 which connects to a toggle or tumbler switch 36. Reference numeral 37 denotes a line for the drive means 30, while reference numeral 38 denotes a line to the heating device 25, the line 38 being provided with a heat-resistant sheathing.

The mode of operation of the drive unit 30 and the procedure for sealing containers can be found from German patent application No. P 32 10 566.5, although the present invention can also be used in relation to sealing devices or the like having another drive unit.

In addition to the detail features set forth in the above-identified patent application, means are provided, in the present application, for fitting cover films or foils or the like, as well as a severing means.

A roll 61 of coiled cover material is mounted on the transverse member 7 between two support bars 60. The material may be unrolled from the roll 61, as a web or film or foil 62. The web 62 is passed around a guide roller 63 which for example may also be in the form of a dancer roller. The film or foil 62 then passes into a slot 65 formed from two strip portions 64 which are disposed in a funnel-like configuration, where the direction of the film or foil 62 is changed, in an elbow bend configuration 66, so as to extend substantially parallel to the direction of movement of the drawer 15. The outer strip portion **64*a* (see FIG. 1) is provided, in the region of the elbow bend configuration, with elongate holes 67 to permit access to the web of material 62** and in particular to facilitate the operation of initially inserting same.

Figure 3:
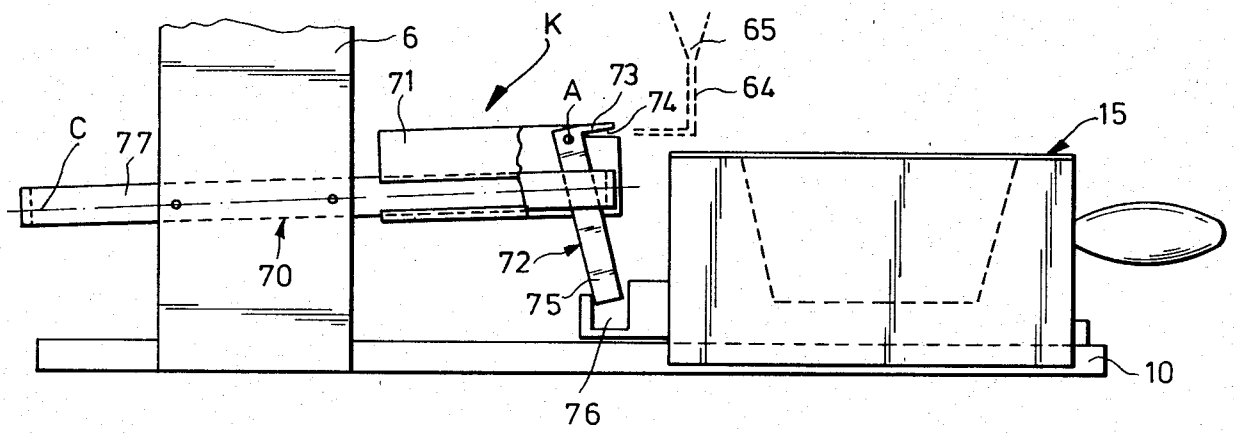
FIG. 3 shows a side view of a clamping means, on an enlarged scale.
Figure 4:
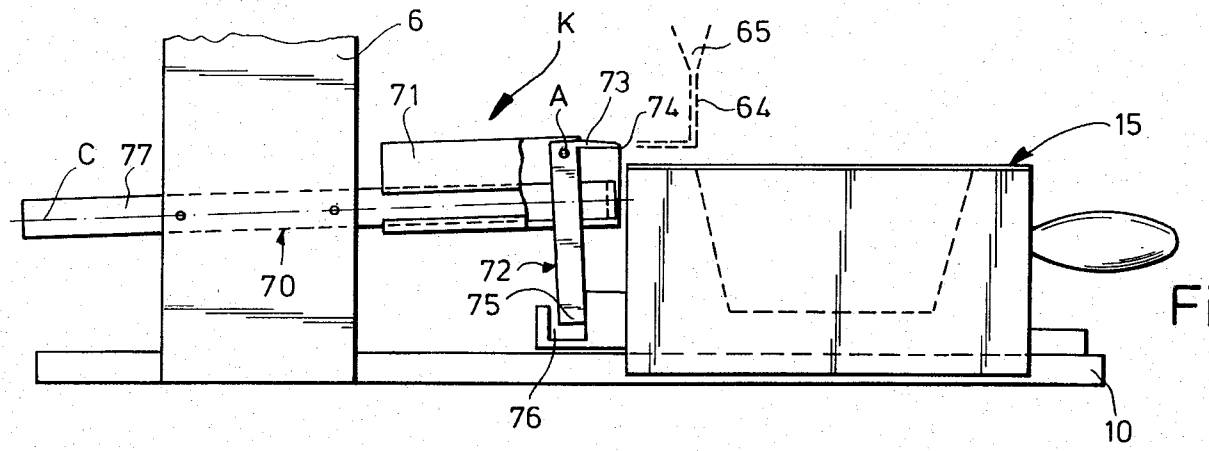
FIG. 4 shows a side view on an enlarged scale of the clamping means shown in FIG. 3, in the closure position.

After it has been inserted into the slot 65, the web 62 can be gripped by a clamping means K. As shown in FIGS. 3 and 4, the clamping means K comprises guide members 70 which are secured to the columns or pillars 5 and 6, for carrying slide members or runners which, in conjunction with respective levers 72 which are pivotal about an axis A and which each have a beak-like lug or projection 73, form a clamping gap 74. The lever 72 engages with its foot or base portion 75 into a channel 76 which is disposed transversely with respect to the rail 10, on the drawer member 15.

The guide members 70 which are embraced by the slide members or runners 71 in such a way as not to be easy to move have longitudinal axes C which extend at an inclined angle with respect to the longitudinal axis of the housing 1 so that the respective clamping gap is moved towards the film or foil 62 or the slot 65 and, after receiving the film or foil 62, draws it away over the drawer member 15 or the container B. In order to permit movement of the lever 72 together with the slide member or runner 71, the guide member 70 has an opening 77. The fact that the slide member or runner 71 does not move easily on the guide member 70 provides that, particularly when displacing the drawer member 15, more force is applied by way of the channel 76 to the lever 72 and at that point, because of the favourable force transmission effect, as a result of the adjacent positioning of the axis A to the lug or projection 73, considerably more pressure is applied to the lug or projection 73 and the clamping of the film or foil 62 in the clamping gap 74 is improved.

Figure 5:
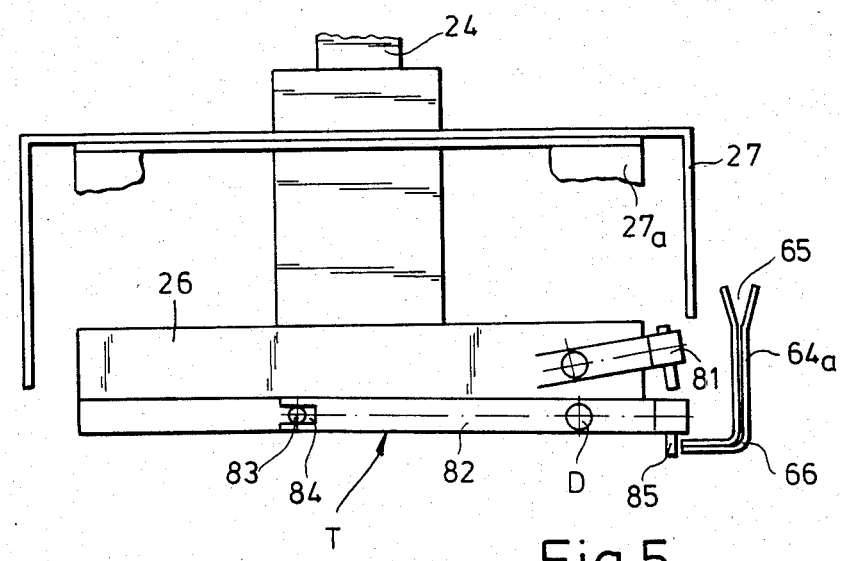
FIG. 5 shows a side view on an enlarged scale of a severing means.

For the purposes of separating from the roll 61, the portion of the film or foil 62 which is to be sealed on to the container or which has been so sealed, the invention also provides a severing means T as shown in FIG. 5. The severing means comprises a bracket or loop member 80 which is held between the two columns or pillars 5 and 6 and which is of such a configuration that, in the open position of the apparatus R, the end beam or bar 81 thereof, which has the actual severing tool (not shown), disappears behind the cladding or casing 27, but the side support arms 82 thereof extend out of the cladding or casing 27 and are pivotally connected to the pillars or columns 5 and 6 and lateral portions of the cladding or casing, as indicated at 27*a*. In that respect, the connection between the cladding or casing 27*a* and the support arm 82 comprises a pivot axis D, while a pin or bolt 83 on the respective column or pillar 5 or 6 respectively engages into an elongate recess 84 at the base of the support arm 82. In that way, the member 81 is also lowered, with the movement of the heating member 26, but by a smaller amount in relation thereto, the extent of the movement of the member 81 being such that the member 81, with its severing tool, meets the web 62 when the web 62 is already being pressed by the heating member 26 on to the edge portion 16 around the opening of the container B.

A heating wire which is held or tensioned between two electrodes 85 may be used in particular as the severing tool.

We claim:

1. Apparatus for sealing a film or foil or the like on to a container, by means of a downwardly movable heating device which is arranged between two columns or pillars bridged by a transverse member and below which the container can be passed, in a carrier member, characterized in that a clamping means (K), for receiving the film or foil (62) or the like, is coupled to the carrier member (15), said clamping means comprises guide means (70) which are secured to the columns or pillars (5, 6) and on which are slidably disposed slide members (71) which are each traversed by a respective lever (72) provided with a beak-like projection or lug (73) and rotatable about an axis (A), and, together therewith, form a clamping gap (74) for receiving the film or foil (62), wherein the lever (72) is connected to the carrier member (15) at the other end from the lug or projection.

2. Apparatus according to claim 1 characterised in that the lever (72) freely movably projects with a base portion (75) into a channel (76) associated with the carrier member and/or the axis (A) is arranged adjacent the beak-like lug or projection (73).

3. Apparatus according to claim 1 characterised in that the longitudinal axes (C) of the guide means (70) extend at an inclined angle with respect to the direction of feed movement (x) of the carrier member (15) and/or the slide members (71) clampingly embrace their respective guide means (70).

4. Apparatus according to claim 1 characterised in that the film or foil (62) or the like can be guided to close to the clamping means (K) by a slot means (65) formed by two strip portions (64), wherein the slot means (65) is possibly arranged transversely with respect to the direction of feed movement (x) of the carrier member (15) and deflects the film or foil (62) into the direction (x) by way of an elbow bend configuration (66), in the region of which the outer strip (64*a*) can preferably be interrupted by elongate holes (64) to permit access to the film or foil (62).

5. Apparatus according to claim 1 characterised in that the film or foil (62) is wound to form a roll (61) which is mounted on the transverse member (7) between two support bars (60) and/or that a severing means (T) for separating off a portion of film or foil which has been sealed on to the container is arranged on the heating device (25), wherein the severing means preferably comprises a severing tool secured to the casing of the heating member.

6. Apparatus according to claim 5 characterised in that the severing means (T) comprises a loop member (80) with an end beam or bar (81) and two support arms (82), wherein a severing tool is secured to the end bar, and wherein optionally the end bar (81) with the severing tool, in the rest position of the apparatus (S), is covered by parts (27) of the heating device (25), while the support arms (82), at one end, adjacent to the end bar (81), are pivotally connected to the heating device (25) by a pivot axis (D) and, at their ends remote from the end bar (81), have a respective recess (84) into which pins engage, from the columns or pillars (5, 6).

7. Apparatus according to claim 6 characterised in that the severing tool is a heating wire disposed below the end bar (81) between two electrodes (85) and/or the heating device (25) has a heating member (26) which comprises two plates, wherein the lower sealing plate is releasably secured to the upper plate and preferably has at least one pin on its top side, which pin engages with a spherical head through the other plate where it is clampingly held by two clips.

* * * * *